US006685084B2

(12) United States Patent
Timbrook et al.

(10) Patent No.: US 6,685,084 B2
(45) Date of Patent: Feb. 3, 2004

(54) TEAR-AWAY TOP BULK BIN CONTAINER

(75) Inventors: Ronald D. Timbrook, Edgertown, OH (US); William J. Remaks, Louisville, KY (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/172,240

(22) Filed: Jun. 14, 2002

(65) Prior Publication Data

US 2002/0148883 A1 Oct. 17, 2002

Related U.S. Application Data

(63) Continuation of application No. 09/792,004, filed on Feb. 3, 2001.

(60) Provisional application No. 60/185,015, filed on Feb. 25, 2000.

(51) Int. Cl.[7] ..... B65D 5/54

(52) U.S. Cl. ..... 229/101.1; 229/235; 229/239; 229/939

(58) Field of Search ..... 229/101.1, 235, 229/238, 239, 939

(56) References Cited

U.S. PATENT DOCUMENTS

| | | | | | |
|---|---|---|---|---|---|
| 1,097,390 | A | * | 5/1914 | Corwin | 229/235 X |
| 2,771,385 | A | * | 11/1956 | Humphner | 229/235 X |
| 2,829,701 | A | * | 4/1958 | Keely | 229/235 X |
| 3,043,490 | A | * | 7/1962 | Burnett | 229/235 X |
| 3,469,766 | A | * | 9/1969 | Nelson | 229/235 X |
| 3,850,363 | A | * | 11/1974 | Jacobs | 229/235 X |
| 4,601,407 | A | * | 7/1986 | Gillard | 229/DIG. 4 |
| 4,784,271 | A | * | 11/1988 | Wosaba, II et al. | 229/919 X |
| 5,098,757 | A | * | 3/1992 | Steel | 229/235 X |
| 5,464,151 | A | * | 11/1995 | Parker et al. | 229/206 |

OTHER PUBLICATIONS

The Wiley Encyclopedia of Packaging Technology, 1986, pp. 66–76.*

* cited by examiner

*Primary Examiner*—Tri M. Mai

(57) ABSTRACT

A bulk bin container and blank is provided having container walls formed of triple wall paperboard material. At least one tear tape is attached laterally to the inside surface of the triple wall material. The tear tape includes first and second ends, with the tear tape itself defining upper and lower container portions. An opening mechanism is provided at the tear tape first end for starting the tape. During use, an operator grasps the opening mechanism and pulls outward and upward on the tear tape, thereby stepping through the triple wall material and separating the upper container portion from the lower container portion.

16 Claims, 2 Drawing Sheets

TEAR-AWAY TOP BULK BIN CONTAINER

RELATED APPLICATIONS

This application claims priority to and is a continuation of U.S. application Ser. No. 09/792,004 filed Feb. 3, 2001, which claims priority to U.S. Provisional Application No. 60/185,015 filed Feb. 25, 2000, the benefit of which is hereby claimed under 35 U.S.C. 119(e).

FIELD OF THE INVENTION

The present invention relates to triple wall bulk bins commonly used to ship large and/or heavy products to stores, and more particularly, to those bins used at the store to provide the product directly to the customer without further unpacking, e.g., watermelon containers, pumpkin containers, potato bins, etc.

BACKGROUND OF THE INVENTION

Known bulk bins are generally formed as multi-sided paperboard containers sized to fit on a standard grocery pallet (i.e., with a width and depth of approximately 40 inches by 48 inches.) Such containers may include top and/or bottom flaps, or may be formed simply as a sleeve. Triple wall corrugated material is normally used in the construction of these bins to accommodate the heavy weight of the product that is packed and shipped in these types of containers. For example, it is not usual for the products alone to range from 600 pounds to 1200 pounds for packaging in a single bulk bin container.

In the produce industry, bulk bins are formed and loaded at actual growing areas and then stacked two-or-three high in refrigerated trucks or other vehicles for shipping. Most bulk bin containers end up on the floor of a supermarket produce department, where the produce packed in the bins is merchandised directly to consumers without further handling. The consumer simply selects the produce they want directly out of the bin.

One problem associated with known bulk bins is the difficulty in opening the bins. If the bin is sealed, a store clerk must cut or tear open some portion of the bin. Even if the container includes upper flaps that are opened, the flaps are still usually cut off by a store clerk, to get them out of the way of consumers. As an alternative, some store owners prefer to cut bulk bin containers along a horizontal line to create a separable upper "lid" portion. This helps the consumer reach the product, but is a difficult task for the store clerk. Another problem is that even when the flaps or upper portions are removed, the containers are often too tall for consumers to reach the product within as the container's supply diminishes.

Tear strips, tear tapes, rip cords and the like, are well known in container design and are easy to use. Designers have addressed the above problems in bulk bin containers by trying to create a bulk bin container that includes a tear strip. For example, U.S. Pat. Nos. 3,189,251; 3,873,017; and 4,784,271 each describe a bulk bin container having walls or at least some portion of wall formed of triple wall material and having a tear strip for use in opening the container. These patents, however, describe arrangements in which the tear strip must rip through what appears to be only a single corrugated layer. The remaining layers are opened by pre-formed cuts in the container wall material. Such designs are not optimal. Pre-forming cuts is time consuming and expensive, and can substantially weaken the bin during the transit phase of the distribution cycle.

Thus, a need exists for an improved bulk bin container and method of opening. Ideally, such a container would be easily formed from a single blank of triple wall corrugated material, would be easily opened without using a cutting tool or requiring significant strength, and would be durable enough to travel long distances in potentially rough circumstances. Further, the ideal container would be openable at a location that makes it easy for a consumer to reach the product within, even as the product supply diminishes. The present invention is directed to fulfilling these needs and others as described below.

SUMMARY OF THE INVENTION

A bulk bin container is provided having container walls formed of triple wall paperboard material with fluting oriented in an upright direction. At least one tear tape is attached laterally to the inside surface of the triple wall material. The tear tape includes first and second ends, with the tear tape itself defining upper and lower container portions. An opening mechanism is provided at the tear tape first end for starting the tape. During use, an operator grasps the opening mechanism and pulls outward and upward on the tear tape, thereby stepping through the triple wall material and separating the upper container portion from the lower container portion.

In accordance with aspects of this invention, the triple wall material is triple "A" fluted material. Alternatively, one of the fluted layers may be formed of "C" flute material instead. In one embodiment, the material includes four liners and three fluted layers interspersed between the four liners. In another embodiment, the triple wall material includes an inner paper facing, a first fluted medium, a first inner liner, a second fluted medium, a second inner liner, a third fluted medium, and an outer facing.

Various embodiments are described regarding the size and number of tear tapes provided. In one embodiment, the tear tape is formed around the entire container as assembled so that when pulled, the upper and lower container portions separate completely. The container may include a single tear tape or may be formed with multiple tear tapes, preferably located in a vertically space-apart relation.

In addition, various opening mechanisms may be used. In one embodiment, the opening mechanism includes a push-in flap and a pop-out handle. The push-in flap is located adjacent the pop-out handle flap, and the pop-out handle is connected to the tear tape. During use, the operator pushes the push-in flap inward in order to grasp the pop-out handle, and pulls upward and outward on the handle. This action starts the tearing of the container wall and the separating of the upper and lower portions.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
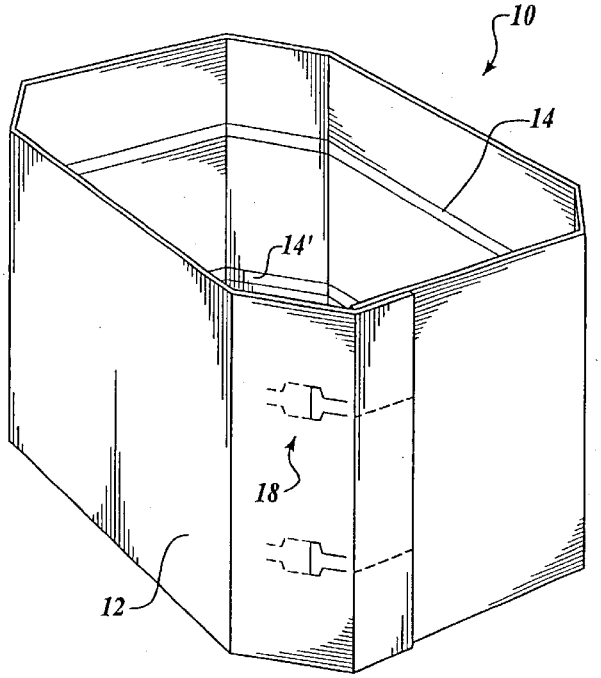
FIG. 1 is a perspective view of an assembled bulk bin container formed in accordance with the present invention.

The present invention is a bulk bin blank 20 and resulting container 10 for shipping and merchandising large and/or heavy products to consumers. The container 10 includes upright container walls 12 and a tear tape 14 attached to an inner surface 16 of such walls. The tear-tape 14, when grasped via an opening mechanism 18, allows a store merchandiser to remove a top portion of the bin. Once removed, the product in the bin is readily seen by consumers, and easily accessed for lifting and removal of product from the bin. Additional tear tapes 14 may be positioned at various heights along the container 10. Thus, the present invention provides enhanced merchandising features as well as improved consumer safety by reducing incidents where consumers might be tempted to reach down into a partially empty bin to lift a heavy produce item, such as a watermelon, out of the bin.

Figure 2:
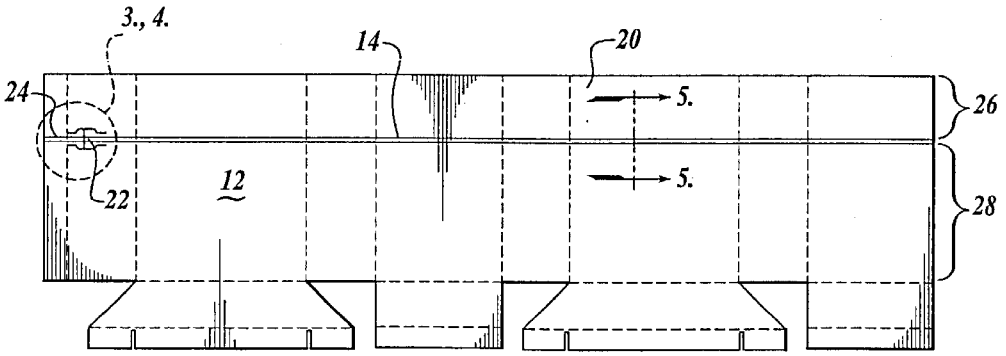
FIG. 2 is an inside plan view of a bulk bin container blank formed in accordance with the present invention.

Referring to FIGS. 1 and 2, the container 10 is preferably formed from a single-piece blank 20 of triple wall corrugated material. The tear tape 14 is located laterally on the innermost wall surface, preferably adhered thereto using a thermoset adhesive or other type glue. The tear tape is formed from a conventional tear tape material, such as nylon filament, kraft-backed tape, etc. In one embodiment, the tear tape is formed from filament strands having an aggregate tensile strength of 90 lbs or more. The tear tape includes first and second ends 22, 24, and is preferably sized in the range of about 0.25 inches to about 1.5 inches wide. The tear tape defines upper and lower portions 26, 28 of the container. In one embodiment, the tear tape 14 is formed around the entire container 10 as assembled, so that when pulled, the upper and lower portions 26, 28 separate completely.

The tear tape 14 may be located at a relatively high level to allow only the uppermost portion of the container to be torn away. In another embodiment, the tear tape 14 is located roughly one-third to one-half the distance down from the top of the bin. In yet other embodiments, multiple strips are provided laterally at different heights, so that the container sidewall height may be reduced as the product within the container 10 is depleted. See FIG. 1 items 14 and 14'.

Figure 3:
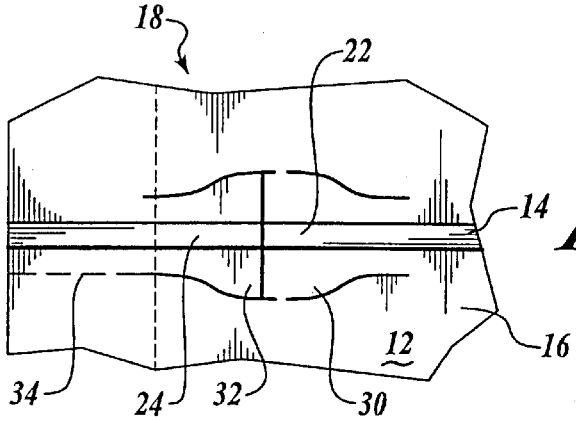
FIG. 3 is a detail inside view of one embodiment of an opening mechanism formed in accordance with the present invention.
Figure 4:
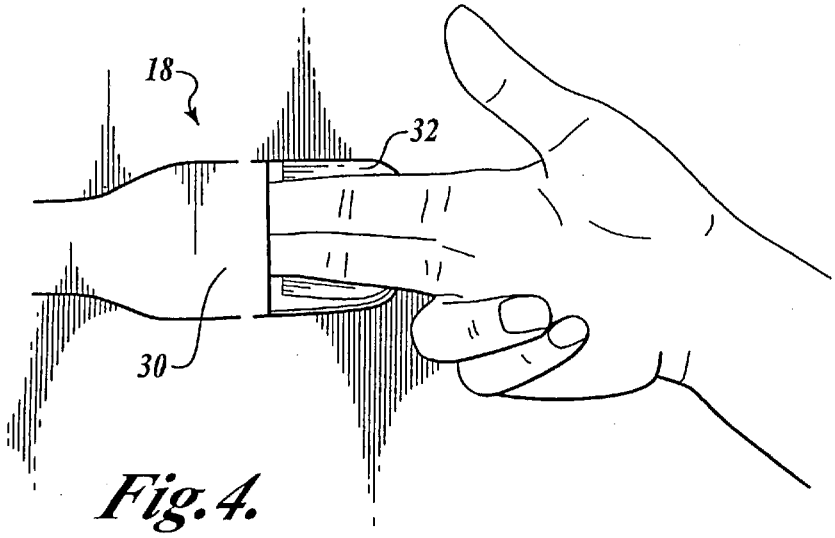
FIG. 4 is a detail outside view of the mechanism shown in FIG. 3.

FIGS. 3 and 4 illustrate one embodiment of an opening mechanism. In this arrangement, a die cut pop-out handle 30 is formed from scores in the container walls. Another set of scores forms a push-in flap 32. The pop-out handle 30 is connected to the tear tape first end 22. To open the container 10, a user pushes in the push-in flap 32 and grasps the pop-out handle 30. The pop-out handle 30 is then used to initiate the tearing action of the tear tape by having the user pull with a generally upward and outward action through the wall. As the tear tape 14 is pulled, it steps through the triple wall material and separates the upper container portion 26 from the lower container portion 28.

Additional cuts in the triple wall material may be used if desired to assist the tear tape in tearing through the wall material. For example, in FIGS. 2 and 4, additional cuts 34 are provided in an overlapping container wall glue flap. The heavy product weight within the bins also helps to anchor the bin in position so that strong purchase and leverage can be applied to the tear tape 14 without concern for the bin moving during tearing. In most cases, the tearing results in a fairly clean edge on the remaining lower container portion 28, thereby minimizing damage to the facing of the bin and any graphics thereon.

While the use of tear tapes to open the tops of single-wall boxes is commonly known, the use of such on a triple wall bulk bin is not. As a designer of containers for many years, one of the present inventors is aware that other bulk bin designers consider triple wall corrugated material to be very strong and consider the use of tear tapes with triple wall material to be impracticable. It is a common misperception amongst these other designers that the thickness (or caliper) of a triple wall material (e.g., ½ inch to 9/16 inch thick) as well as the typical heaviness of the paper used in the board combination, would make it nigh impossible to manually pull a tear tape through that much material.

The inventors herein have discovered that if a wide caliper triple wall board is used, such as triple wall corrugated material configured with all three flutes being "A" flute rather than the lower caliper "C" or "B" flutes, then the tear tape shows a tendency to step-through or "pop" through each flute layer, one layer at a time. As is understood in the art, various designations are possible for the fluting material to provide an indication of the caliber of thickness, with "A" fluting being the thickest rating, followed by "C" fluting and then "B" fluting.

When pulling the tear tape through the triple wall material, the inner layers fracture first, making a popping sound when torn. The slight sequencing involved in the tearing of each layer allows the triple wall material to be opened without requiring significant strength. Thus, this discovered popping action in wider caliper triple wall material makes it relatively easy for an operator to tear through the container and separate an upper portion. The fluted layers are preferably constructed of a lighter weight paperboard (e.g., semi-chemical medium) than the adjacent inner liners or outer liners. This fact coupled with the air caps created by the shape and caliper of the "A" size fluting helps the step-through or "popping" action to occur.

When smaller caliper flutes such as "C" or "B" are utilized in the triple wall construction, the material becomes increasingly difficult to step through. Overall, when the caliper falls below 0.5 inches, the operation becomes impracticable. In one embodiment, the triple wall material includes three fluted layers, two of the fluted layers being "A" flutes, and the third fluted layer being one of "A" flute and "C" flute. In other embodiments, the triple wall material is at least 0.5 inches thick.

Figure 5:
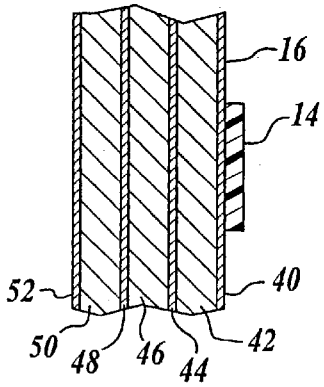
FIG. 5 is a cross-sectional view of a container side wall formed in accordance with the present invention.

Referring to FIG. 5, in one embodiment, the triple wall material includes an inner paper facing 40, a first fluted medium 42, a first inner liner 44, a second fluted medium 46, a second inner liner 48, a third fluted medium 50, and an outer facing 52. The fluting is oriented in the container in an upright direction. The crosshatching in FIG. 5 of the fluted mediums 42, 46, and 50 is meant to indicate the fluting is oriented in an up-and-down direction (i.e., within the plane of the patent paper itself, as opposed to orthogonal to the paper.)

As will be appreciated from a reading of the above, the present invention bulk bin container 10 and method of opening is a significant improvement over prior bulk bins. The container is easily formed from a single blank of triple wall corrugated material, easily opened without using a cutting tool or requiring significant strength, and is durable enough to travel long distances in potentially rough circumstances. Further, the container is openable at locations that make it easy for a consumer to reach the product within, even as the product supply diminishes.

While the preferred embodiment of the invention has been illustrated and described, it will be appreciated that various changes can be made therein without departing from the spirit and scope of the invention. In particular, the blank 20 of FIG. 2 is one embodiment of a bulk bin container formed in accordance with the present invention. Other embodiments of a bulk bin container may be used. For example, the container may be made to include fully closing upper and lower flaps. Such other designs are fully within the scope of the present invention as set forth in the claims below.

The embodiments of the invention in which an exclusive property or privilege is claimed are defined as follows:

1. A bulk bin container comprising:

(a) container walls formed of triple wall corrugated material, the fluting being oriented in an upright direction as assembled, the container walls including a glue flap configured to join the walls;

(b) at least one tear tape attached laterally to the inside surface of the triple wall material; the tear tape including first and second ends, the tear tape defining upper and lower container portions;

(c) an opening mechanism provided at the tear tape first end for starting the tape, the opening mechanism being adjacent the glue flap and configured with slits through a portion of the glue flap;

(d) wherein to use, the operator grasps the opening mechanism and pulls outward and upward on the tear tape, thereby stepping through the triple wall material and separating the upper container portion from the lower container portion.

2. The container according to claim 1, wherein the triple wall corrugated material includes three fluted layers, at least two of the fluted layers being "A" flutes.

3. The container according to claim 1, wherein the triple wall corrugated material includes four liners and three fluted layers interspersed between the four liners.

4. The container according to claim 1, wherein the triple wall corrugated material includes an inner paper facing, a first fluted medium, a first inner liner, a second fluted medium, a second inner liner, a third fluted medium, and an outer facing.

5. The container according to claim 1, wherein the triple wall corrugated material is at least 0.5 inches thick.

6. The container according to claim 1, wherein the tear tape is sized in the range of about 0.5 inches to about 1.5 inches wide.

7. The container according to claim 1, wherein the tear tape is formed from at least one of nylon filament, kraft-backed tape, and multi-strand material having an aggregate tensile strength of at least 90 lbs.

8. The container according to claim 1, wherein tear tape is formed around the entire container as assembled so that when pulled, the upper and lower portions separate completely.

9. The container according to claim 1, wherein the tear tape is located approximately two-thirds up the container height as assembled.

10. The container according to claim 1, wherein the opening mechanism includes a push-in flap and a pop-out handle, the push-in flap located adjacent the pop-out handle flap, the pop-out handle being connected to the tear tape; during use, the operator pushes the push-in flap inward and then grasps the pop-out handle and pulls upward and outward, this action thus starting the tearing of the container wall and the separating of the upper and lower portions.

11. The container according to claim 1, wherein the at least one tear tape includes two tear tapes each attached laterally to the inside surface of the triple wall material in a vertically space-apart relation.

12. A blank for a container comprising:

(a) a single sheet of triple wall corrugated material cut and scored to define container walls having an inside surface, said container walls including a glue flap;

(b) at least one tear tape attached laterally to the inside surface of the container walls, the at least one tear tape including first and second ends; and (c) an opening mechanism provided at the tear tape first end, said opening mechanism being adjacent the glue flap in the formed container and configured with slits through a portion of said glue flap.

13. The blank of claim 12, wherein the triple wall corrugated material includes three fluted layers, at least two of the fluted layers being "A" flutes.

14. The blank of claim 12, wherein the triple wall corrugated material is at least 0.5 inches thick.

15. The blank of claim 12, wherein the at least one tear tape is sized in the range of about 0.25 inches to about 1.5 inches wide.

16. The container according to claim 12, wherein the tear tape is formed from at least one of nylon filament, kraft-backed tape, and multi-strand material.

* * * * *